United States Patent [19]

Kyrias

[11] 4,240,165

[45] Dec. 23, 1980

[54] SPA INSTALLATION

[76] Inventor: George Kyrias, 31112 Via Santo Tomas, San Juan Capistrano, Calif. 92675

[21] Appl. No.: 4,997

[22] Filed: Jan. 22, 1979

[51] Int. Cl.[3] ..... E04H 3/18; E04H 3/20; A47K 3/14

[52] U.S. Cl. ..... 4/493; 4/505; 4/509

[58] Field of Search ..... 4/172, 173 R, 172.15–172.17, 4/175, 177, 179, 180, 183, 178; 128/66

[56] References Cited

U.S. PATENT DOCUMENTS

| | | | |
|---|---|---|---|
| 904,133 | 11/1908 | Kennedy | 4/183 |
| 1,051,741 | 1/1913 | Litton | 4/183 |
| 3,781,925 | 1/1974 | Curtis | 4/172.15 |
| 3,801,992 | 4/1974 | Sable | 4/172.17 |
| 4,001,899 | 1/1977 | Mathis | 4/172.16 X |
| 4,149,281 | 4/1979 | Bob et al. | 4/172.15 |

*Primary Examiner*—Stuart S. Levy

*Attorney, Agent, or Firm*—Smyth, Pavitt, Siegemund, Jones & Martella

[57] ABSTRACT

A construction which permits existing swimming pools to be provided with a spa at low cost includes a removable partition which is mounted in the pool to define the space to be used as a spa. A special gasket forms a seal between the partition and the pool. Valves are installed in the existing pool suction pipe and pool return pipe to permit the flow to be diverted to the spa. No excavation is required to install the spa. An adjustable template is used to determine the proper size and shape of the removable partition. The pipe through which water enters the spa is provided at its end with a jet nozzle which includes a venturi for introducting air into the incoming stream of water.

7 Claims, 3 Drawing Figures

10
12
14
16
18
20
21
22
23
24
25
26
27
28
30
32
34
36
38
40
2
2

SPA INSTALLATION

BACKGROUND OF THE INVENTION

1. Field of the Invention

The present invention is in the field of swimming pool construction, and more specifically relates to a construction which permits existing swimming pools to be provided with a spa at low cost.

2. The Prior Art

Swimming pools are customarily provided with a water pump, a filter, and a heater. The pump circulates the water from the pool, drawing the water in from the pool through a pool suction pipe. The pump then drives the water through the filter which cleanses the water, and through the heater which can be used to maintain the water at a selected comfortable temperature. After passing through the heater, the water is reintroduced into the pool through a pool return pipe.

A spa is defined as a tub or pool of water, utilizing a water pump, filter, and heater in a manner comparable to a pool. A spa differs from a pool in several characteristic ways. Normally, the water in a spa is maintained at a higher temperature than the water in a pool; temperatures up to 105 degrees F. are not uncommon. Typically, the return pipe of a spa terminates in a venturi water jet which provides a mixture of air to the hot water as the latter is returned to the spa. Normally, a spa is smaller than a swimming pool and is not used for swimming. The cost of installing or constructing a spa in the ground is comparible to the cost of a swimming pool. The number of installed swimming pools far exceeds the number of installed spas. Most pool owners do not install a separate spa, partly because of the additional cost, and partly because once the pool has been installed, there is less space available for the spa. The present invention is intended to permit the owners of swimming pools to enjoy the advantages of a spa with relatively little expense and without giving up any further yard space.

SUMMARY OF THE INVENTION

In accordance with the present invention, a removable partition is installed in an existing swimming pool to divide the space within the pool into a spa portion and a remainder of the pool. A gasket extending around the edge of the partition prevents any appreciable flow of water between the spa portion and the remainder of the pool. Valves are installed in the pool suction pipe and in the pool return pipe to permit the water flowing in those pipes to be selectively diverted to the spa portion through a spa suction pipe and a spa return pipe respectively. In this manner, the water in the spa can be maintained at a different temperature from the temperature of the water in the remainder of the pool. For example, in the winter when it is wasteful of energy and uneconomic to heat the entire pool, the circulation of the water can be diverted so that only the spa is heated, permitting the spa to be enjoyed year round.

No excavation is required to install the spa of the present invention, and it does not decrease the amount of yard space available. For these reasons, the spa of the present invention can be installed in one day, at less than half the cost of a separately excavated spa.

In accordance with the present invention, an adjustable template is used to determine the proper size and shape of the partition installed in the swimming pool.

The use of this adjustable template is a significant factor in achieving the low cost of the installation.

The novel features which are believed to be characteristic of the invention, both as to organization and method of operation, together with further objects and advantages thereof, will be better understood from the following description considered in connection with the accompanying drawings in which a preferred embodiment of the invention is illustrated by way of example. It is to be expressly understood, however, that the drawings are for the purpose of illustration and description only and are not intended as a definition of the limits of the invention.

DETAILED DESCRIPTION OF THE PREFERRED EMBODIMENT

Figure 1:
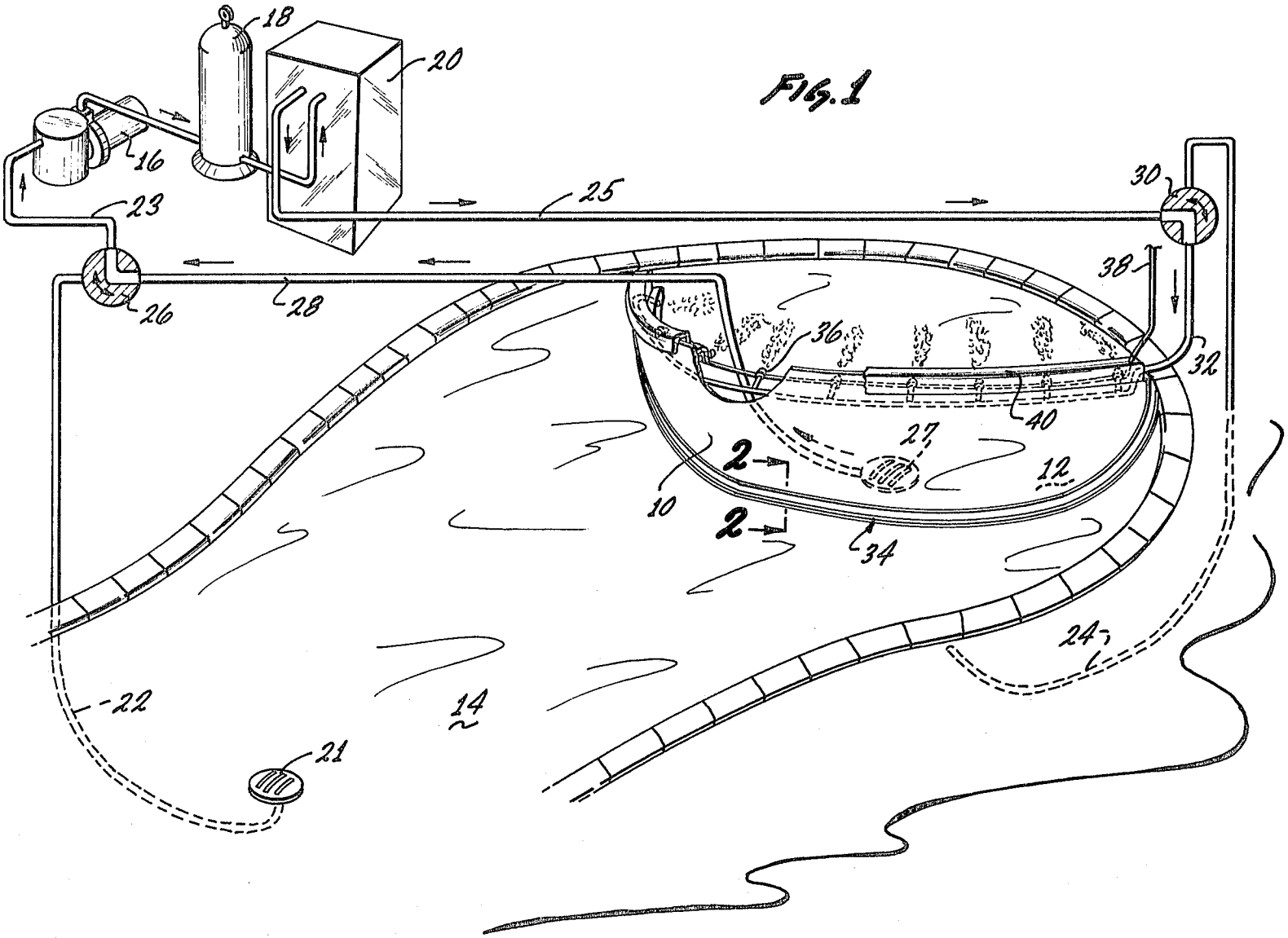
FIG. 1 is a diagrammatic perspective view from above a swimming pool in which a spa of the present invention has been installed.

Turning now to the drawings in which the same reference numerals are used to denote like parts, there is shown in FIG. 1 the way in which the partition 10 is installed in an existing swimming pool to divide the swimming pool into a spa 12 and a remainder 14. In conformity with the almost universal practice, the swimming pool is provided with a pump 16, a filter 18, and a heater 20. The swimming pool typically is provided with a pool suction pipe 22 which communicates with the space inside the pool through an outlet 21. Prior to installation of the partition 10, the pool suction pipe 22 is connected to the suction pipe 23 which leads to the pump 16. Normally, the swimming pool includes a pool return pipe 24 which, prior to the installation of the spa is connected to the return pipe 25. Prior to installation of the spa, the pump 16 draws water from the pool through the outlet 21 into the pool suction pipe 22, through the suction pipe 23 and into the pump 16. The pump forces the water through the filter 18 and the heater 20, and returns the water to the pool through the return pipe 25 and the pool return pipe 24.

In accordance with the present invention, installation of the spa involves installing the partition 10 into the the swimming pool, installing the valve 26 into the existing suction pipe, connecting the spa suction pipe 28 to the valve 26, installing the valve 30 in the return pipe 25, and connecting the spa return pipe 32 to the valve 30. The spa suction pipe 28 terminates in a spa outlet 27 through which water is drawn by the pump 16 from the spa 12 into the spa suction pipe 28, through the valve 26 and into the suction pipe 23.

The spa return pipe 32 terminates in a jet nozzle 36 in a preferred embodiment, through which water is returned to the spa 12 from the heater 20 through the return pipe 25, through the valve 30 and through the spa return pipe 32. In a preferred embodiment, the jet nozzle 36 includes a venturi through which air is drawn through an air pipe 38 so that the water discharged by the jet nozzle includes air bubbles. In a preferred embodiment, the partition 10 is provided with a cap 40 for safety and for decoration.

In a preferred embodiment, the valve 26 is of a type known in the art which is capable of connecting either the pool suction pipe 22 or the spa suction pipe 28 to the suction pipe 23. In other embodiments, the valve 26 permits a selected apportionment between the pipes 22 and 28. Likewise, in a preferred embodiment, the valve 30 permits the flow in the return pipe 25 to be directed either to the spa return pipe 32 or to the pool return pipe 24. In an alternative embodiment, the valve 30 is of a type which permits the flow in the return pipe 25 to be selectively apportioned between the pipes 32, 24. In one embodiment of the present invention, the valves 26, 30 are ganged for simultaneous operation.

Figure 2:
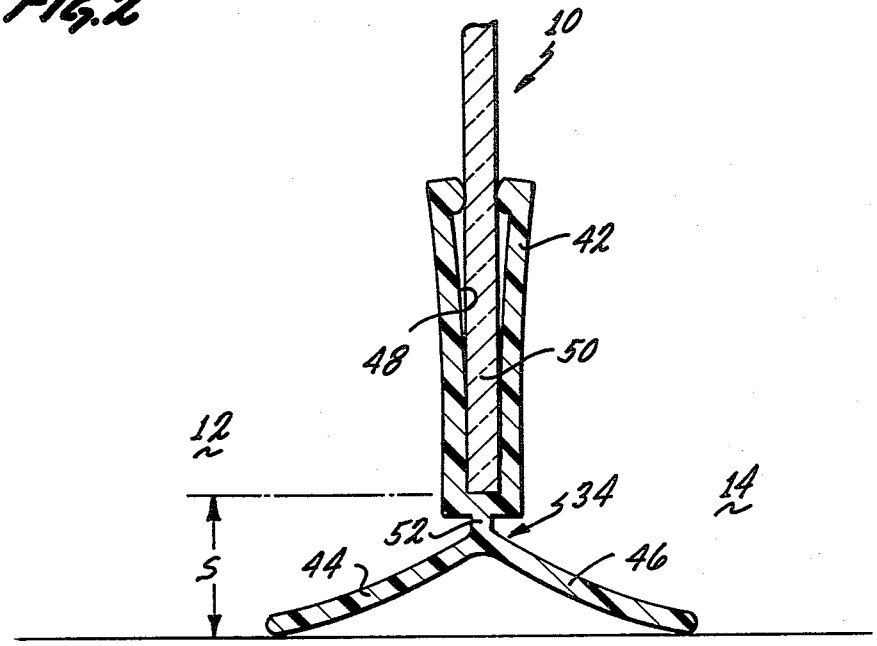
FIG. 2 is a cross sectional view taken in the direction 2—2 of FIG. 1 and showing the gasket used in the present invention to seal off the spa from the remainder of the pool; and, FIG. 3 is a diagram showing an elevational view of the adjustable template used in accordance with the present invention.

In a preferred embodiment, the gasket 34 is a Y-shaped elastomeric object made of polyvinylchloride and having arms 42, 44 and 46 as shown in FIG. 2. One of the arms 42 includes a notch 48 into which the edge 50 of the partition 10 fits in sealing engagement. The other arms 44,46 are pressed into sealing engagement with the bottom floor wall of the swimming pool. In a preferred embodiment, the gasket 34 is formed of a relatively soft, readily conformable material having a durometer softness of at least 90. The gasket 34 further includes a narrowed center portion 52 which enhances its flexibility to facilitate the achievement of a good seal in situations where the wall or bottom of the swimming pool is not strictly perpendicular to the plane of the partition 10.

Figure 3:
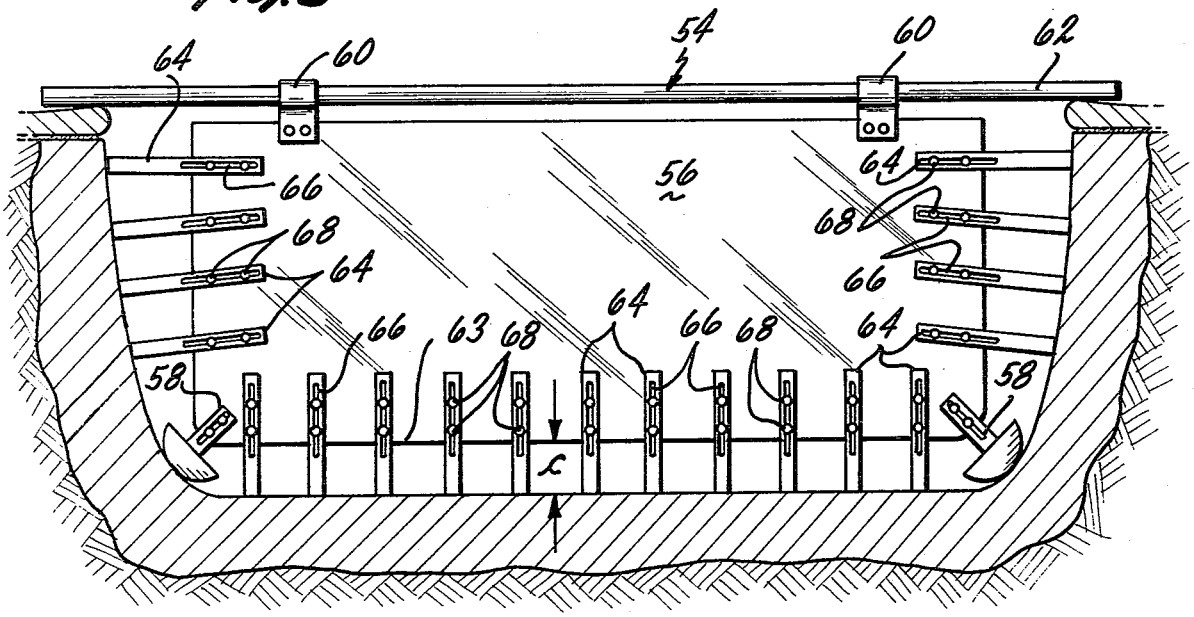

FIG. 3 is a diagram showing in elevational view an adjustable template 54 used in the present invention to determine the proper size and shape to which the partition 10 is to be cut. The adjustable template 54 includes a sheet 56 of rigid material, such as fiberglass, of such a size and shape that it will fit into the swimming pool at the position in which the partition is to be installed, with at least a minimum amount of clearance, denoted by the letter c in FIG. 3, remaining between the sheet 56 and the walls and bottom of the swimming pool. In one embodiment, the sheet is suspended from the pipes 62. A plurality of fingers 64 are spaced along the edge of the sheet 56, and the fingers 64 are aligned generally perpendicularly to the edge 63 of the sheet of material 56. Each of the fingers 64 is provided with a slot 66 and is retained to the sheet 56 by bolts 68.

Once the sheet 56 has been suspended at the position in which the partition is to be installed, the fingers 64 are extended beyond the edge 63 of the sheet 56 until they contact the bottom or the wall of the swimming pool, at which position the fingers are clamped to the sheet 56 by tightening the bolts 68. Once all the bolts 68 have been tightened, the template 64 is removed from the swimming pool and layed against the material from which the partition is to be cut. The locations of the tips of the fingers are marked on the partition material, and the tips of the fingers define a curve matching the shape of the swimming pool in the position at which the partition is to be installed. This curve may be drawn on the partition material and then a second curve, spaced from the first curve by a constant amount may be drawn as the cutting line. The constant space between the two curves allows space, denoted by S of FIG. 2, for the gasket 34. The partition is then cut along the cutting line, the gasket is fitted to it, and the partition is then installed in the swimming pool.

Thus, there has been described a spa installation for use in existing swimming pools. The structure of the spa has been described as well as the method and tool used for producing it. It is to be understood that additional embodiments of the invention which would be obvious to those skilled in the art are considered to be within the scope of the present invention.

What is claimed is:

1. In a swimming pool of the type having walls and a bottom, and in which the space enclosed by the walls and bottom is normally filled with water, having a pool suction line for withdrawing water from the pool, having a pool return line for adding water to the pool, and having a pump, a filter, and a water heater connected in a series combination between the pool suction line and the pool return line so that water withdrawn from the pool may be heated and filtered before being returned to the pool, the improvement comprising in combination:

a removable partition extending across the space enclosed by the walls and bottom of the pool to partition the pool into a spa and a remaining pool space, the pool suction line and the pool return line communicating with the remaining pool space;

said partition adapted to be readily removed from the pool to permit the entire pool to be used for swimming;

a spa suction line communicating with the spa for removing water from the spa;

a spa return line communicating with the spa for adding water to the spa;

means mounting the spa return line on and along the length of said partition; and, valve means for selectively connecting the series combination of the pump, the filter, and the water heater between said spa suction line and said spa return line so that water withdrawn from the spa may be heated, filtered, and returned to the spa;

said partition serving, when installed, to prevent intermixing of the normally warmer water in the spa with the normally cooler water in the remaining pool space to conserve heat energy.

2. The improvement of claim 1 wherein said valve means selectively disconnect the series combination of the pump, the filter, and the water heater from the pool suction line and the pool return line at the same time said valve means selectively connects the series combination of the pump, the filter, and the water heater between said spa suction line and said spa return line.

3. The improvement of claim 1 further comprising:

an elastomeric sealing gasket disposed along the edges of said removable partition which abut the walls and bottom of the pool and forming a seal between the edges of said removable partition and the walls and bottom of the pool.

4. The improvement of claim 3 wherein said elastomeric sealing gasket is composed of polyvinylchloride.

5. The improvement of claim 3 wherein said elastomeric sealing gasket has a durometer softness of at least 90.

6. The improvement of claim 1 wherein said spa return line is connected to a jet nozzle.

7. The improvement of claim 6 wherein said jet nozzle further comprises means for introducing air to the water introduced to the spa through said jet nozzle.

* * * * *